US005261737A

United States Patent [19]

Faust et al.

[11] Patent Number: 5,261,737

[45] Date of Patent: Nov. 16, 1993

[54] GUIDE FOR A LEAF, DRAWER OR THE LIKE

[75] Inventors: Karl-Volker Faust, Bielefeld; Heinz Ohlendorf, Bad Salzuflen, both of Fed. Rep. of Germany

[73] Assignee: Paul Hettich GmbH & Co., Kirchlengern, Fed. Rep. of Germany

[21] Appl. No.: 602,316

[22] PCT Filed: Feb. 23, 1990

[86] PCT No.: PCT/DE90/00122

§ 371 Date: Jan. 8, 1991

§ 102(e) Date: Jan. 8, 1991

[87] PCT Pub. No.: WO90/11033

PCT Pub. Date: Oct. 4, 1990

[30] Foreign Application Priority Data

Mar. 25, 1989 [DE] Fed. Rep. of Germany ..... 8903741

[51] Int. Cl.[5] ..... A47B 96/00

[52] U.S. Cl. ..... 312/334.46; 312/334.44

[58] Field of Search ..... 312/333, 348, 334.46, 312/334.44; 16/82

[56] References Cited

U.S. PATENT DOCUMENTS

| | | | |
|---|---|---|---|
| 2,711,358 | 6/1955 | Gussack | 312/333 |
| 3,123,419 | 3/1964 | Maxwell | 312/333 |
| 3,801,166 | 4/1974 | York | 312/348 |
| 4,423,914 | 1/1984 | Vander Ley | 312/333 |

FOREIGN PATENT DOCUMENTS

| | | | |
|---|---|---|---|
| 3030199 | 3/1982 | Fed. Rep. of Germany | 312/333 |
| 410083 | 9/1979 | Sweden . | |

*Primary Examiner*—Kenneth J. Dorner
*Assistant Examiner*—Gerald A. Anderson
*Attorney, Agent, or Firm*—Darby & Darby

[57] ABSTRACT

A guide for a drawer includes a rail and a device for holding the rail on the drawer. The holding device has a mounting portion which is secured to the drawer by a fastener, a resilient leg and a lever which is perpendicular to the rail. The rail is provided with an aperture and the leg has a protrusion which is receivable in the aperture so as to engage the rail. The protrusion can be withdrawn from the aperture by pulling on the lever. The lever is remote from one end of the leg and at least this end of the leg is fast with the mounting portion of the holding device.

21 Claims, 9 Drawing Sheets

GUIDE FOR A LEAF, DRAWER OR THE LIKE

BACKGROUND OF THE INVENTION

The present invention relates to a guide for a leaf, drawer or the like. The guide includes an outer rail, a guide rail fixable along a longitudinal side of a leaf, drawer or the like, and a locking component fixable to a leaf, drawer or the like. The locking component is provided with a resilient leg having a locking projection which engages in a cutout of the guide rail, and a lever which is connected with this leg. The resilient leg can be actuated, and its locking projection withdrawn from the cutout of the guide rail, by means of the lever which is approximately perpendicular to the longitudinal axis of the guide rail.

Guides of the type described are known per se. The locking component with its resilient leg and the lever connected therewith make it possible to bring a leaf, drawer or the like into operative engagement with the guide rail. The guide rail is movable along a outer rail and the outer rail serves to fix the entire guide to an article of furniture.

During assembly, a leaf, drawer or the like can be pushed along the guide rail until the locking projection of the resilient leg enters the cutout of the guide rail. In this position, relative shifting of the guide rail and the leaf, drawer or the like is no longer possible.

If the leaf, drawer or the like is again to be disengaged from the guide rail, the lever must be manipulated to withdraw the locking projection from the cutout of the guide rail. In this position, complete separation of the guide rail from the leaf, drawer or the like can be achieved.

Both longitudinal sides of a leaf, drawer or the like are equipped with such guides. Hence, locking components are provided on both sides.

With the known guides of this type, there is the danger of unintentional withdrawal of the respective locking projection from the corresponding cutout, particularly in the case of large pulling loads.

SUMMARY OF THE INVENTION

It is an object of the present invention to improve a guide of the above type in such a manner that reliable engagement of the guide rail and the locking component is insured even under extreme loads.

According to the invention, this object is achieved in that at least the end of the resilient leg remote from the lever is connected to a section of the locking component which can be immovably affixed to a leaf, drawer or the like.

This design provides the advantage that the locking projection located between the lever and the juncture of the resilient leg and the locking component firmly catches in the cutout of the guide rail when the leaf, drawer or the like is subjected to large pulling loads. In other words, unintentional release is virtually eliminated even at high loads.

The support for the lever, the locking projection and the juncture of the resilient leg and the locking component, lie approximately on a line paralleling the guide rail. This is favorable both for reliable engagement and for intentional manipulation in the event that release of the guide rail from the locking component is contemplated.

BRIEF DESCRIPTION OF THE DRAWINGS

Exemplary embodiments of the invention, which are described in more detail below, are illustrated in the accompanying drawings wherein.

DESCRIPTION OF THE PREFERRED EMBODIMENTS

Figure 1:
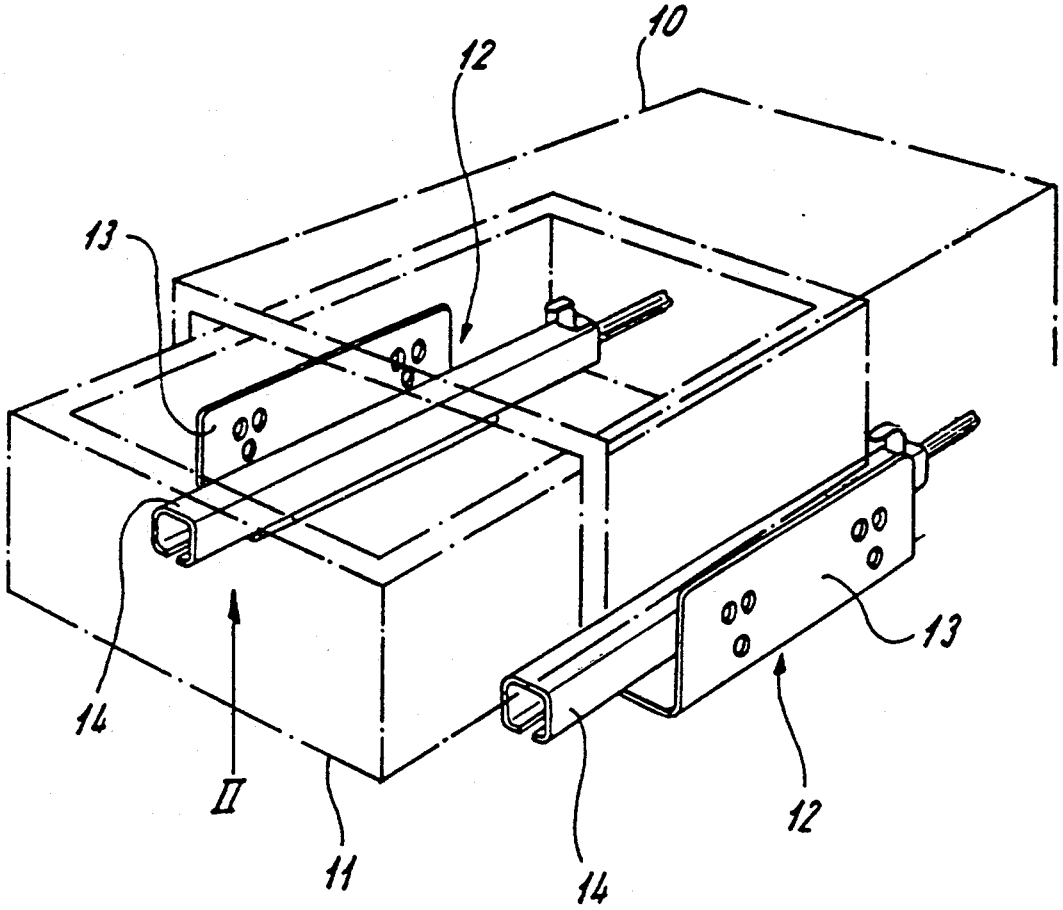
FIG. 1 is a perspective, highly schematic illustration of an article of furniture with a drawer.

The reference numeral 10 in FIG. 1 identifies an article of furniture which is illustrated in phantom and is equipped with a drawer 11 likewise only illustrated in phantom. The drawer 11, or a comparable leaf, is provided with guides at the two longitudinal sides thereof in a manner known per se. The guides are generally identified by the reference numeral 12.

Each of the guides 12 includes an outer rail 13 and a guide rail 14, as well as a locking component 15 which is shown in FIGS. 2 to 5.

The respective outer rails 13 are fixable to the article of furniture while the guide rails 14, which are slidably guided along these outer rails, are fixable at the longitudinal sides of the drawer 11.

Fixing of the guide rails to the drawer 11 is accomplished by means of the previously mentioned locking component 15 which is described below in detail with reference to FIGS. 2 to 5.

Figure 3:
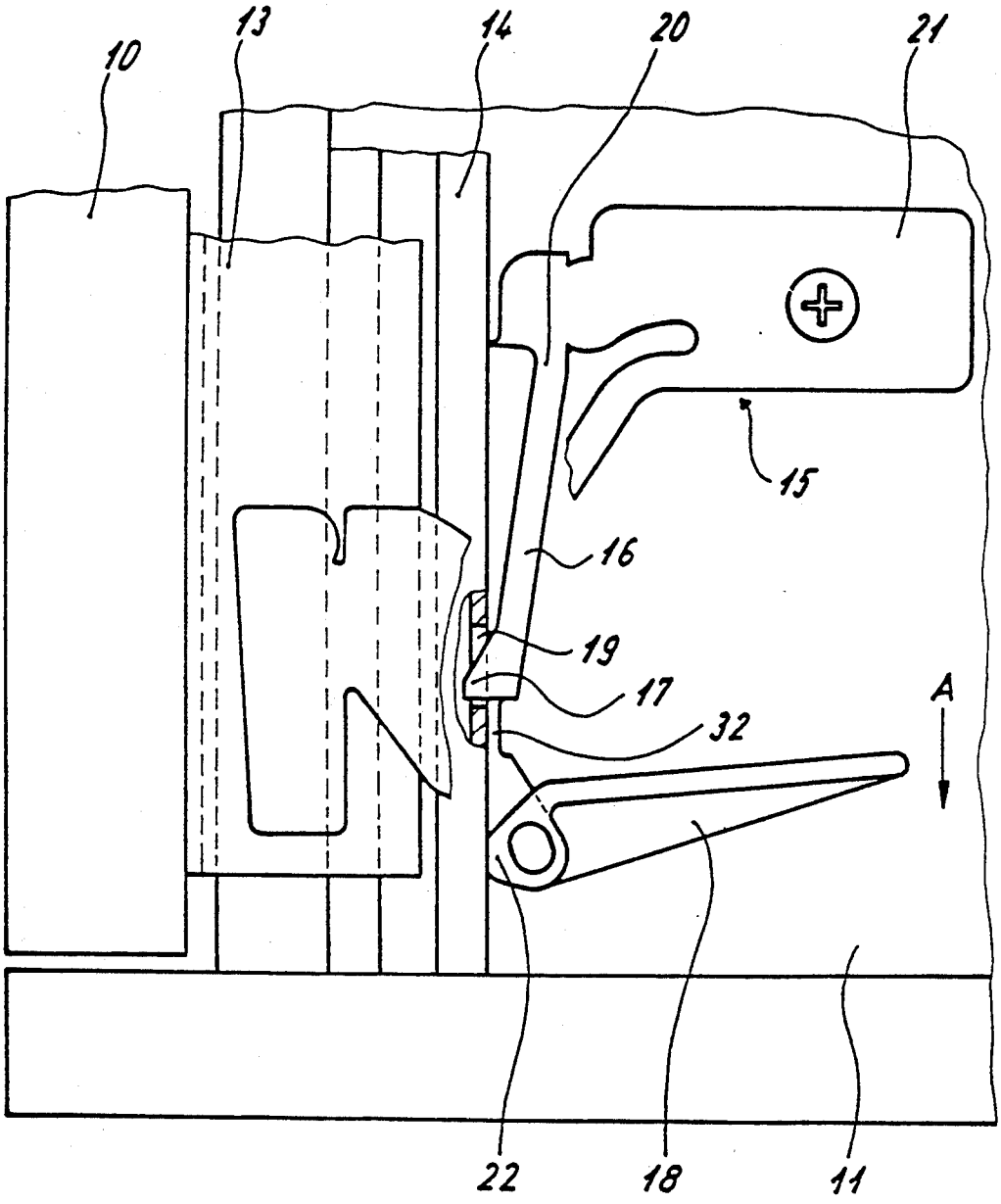
FIG. 3 is a fragmentary view similar to that of FIG. 2 but with a portion of the structural components shown in FIG. 2 omitted.
Figure 4:
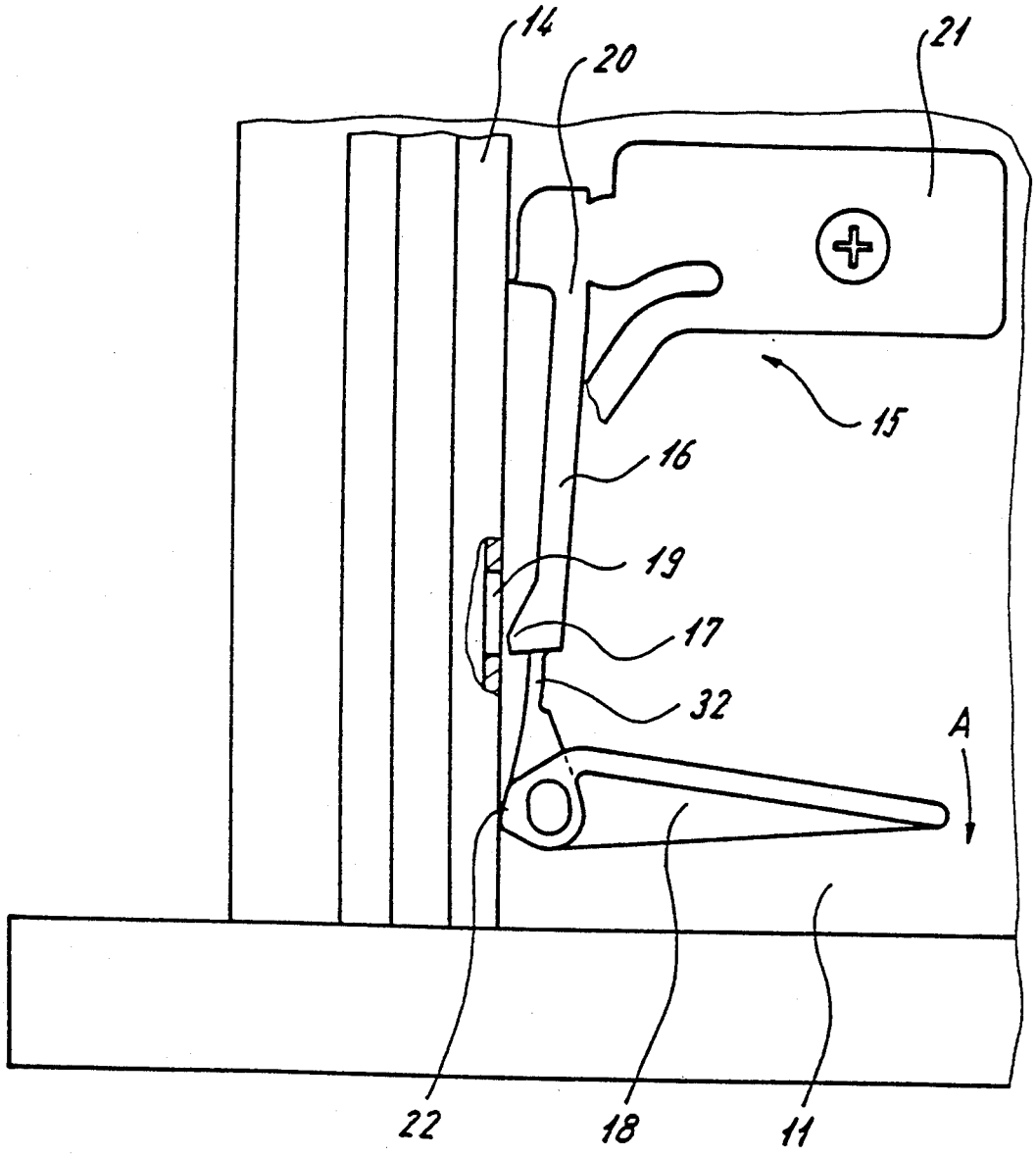
FIG. 4 is a view similar to that of FIG. 3 with a different operative position of the functional components.

As shown particularly clearly in FIGS. 3 and 4, the locking component 15 is provided with a lever 18 and a resilient leg 16 formed with a locking projection 17. The locking component 15 is secured to the drawer 11 in its entirety. The locking projection 17 engages in a cutout 19 of the neighboring guide rail 14 and can again be withdrawn from the cutout 19 by actuation of the lever 18 as illustrated in FIG. 4.

When the locking projection 17 engages in the cutout 19, the desired connection between the guide rail 14 and the drawer 11 is produced. In this position, which is shown in FIG. 3, relative shifting of the drawer 11 and the guide rail 14 is not possible. In other words upon shifting of the drawer 11 relative to the article of furniture, the guide rails 14 connected with the drawer 11 at the longitudinal sides thereof undergo the same motion and thereby shift relative to the outer rails 13.

On the other hand, if the drawer 11 is to be completely released from the article of furniture, e.g., for cleaning, the connection with the guide rails 14 can be broken by actuation of the lever 18 and the drawer 11 completely withdrawn from the article of furniture 10.

FIGS. 2 to 5 make it very clear that the lever 18 for actuating the resilient leg 16 and the locking projection 17 formed thereon extends approximately normal to the longitudinal axis of the guide rail 14. This means that the lever 18 runs approximately parallel to the front side of the drawer 11. Thus, if the lever 18 is to be actuated, it is necessary to pull the lever 18 in the direction of the front side of the drawer 11 as indicated by the arrow A in FIGS. 3 and 4. The lever 18 is very convenient to grasp and pulling of the lever in the stated direction can also be performed without a problem. Manipulation is accordingly greatly simplified in comparison to conventional structures.

In the embodiment of FIGS. 2 to 5, only one end 20 of the leg 16 is connected with the section 21 of the locking component 15 which is secured to the drawer. The free end 22 of the resilient leg 16, on which the lever 18 is formed, bears against the neighboring flank of the guide rail 14.

Figure 2:
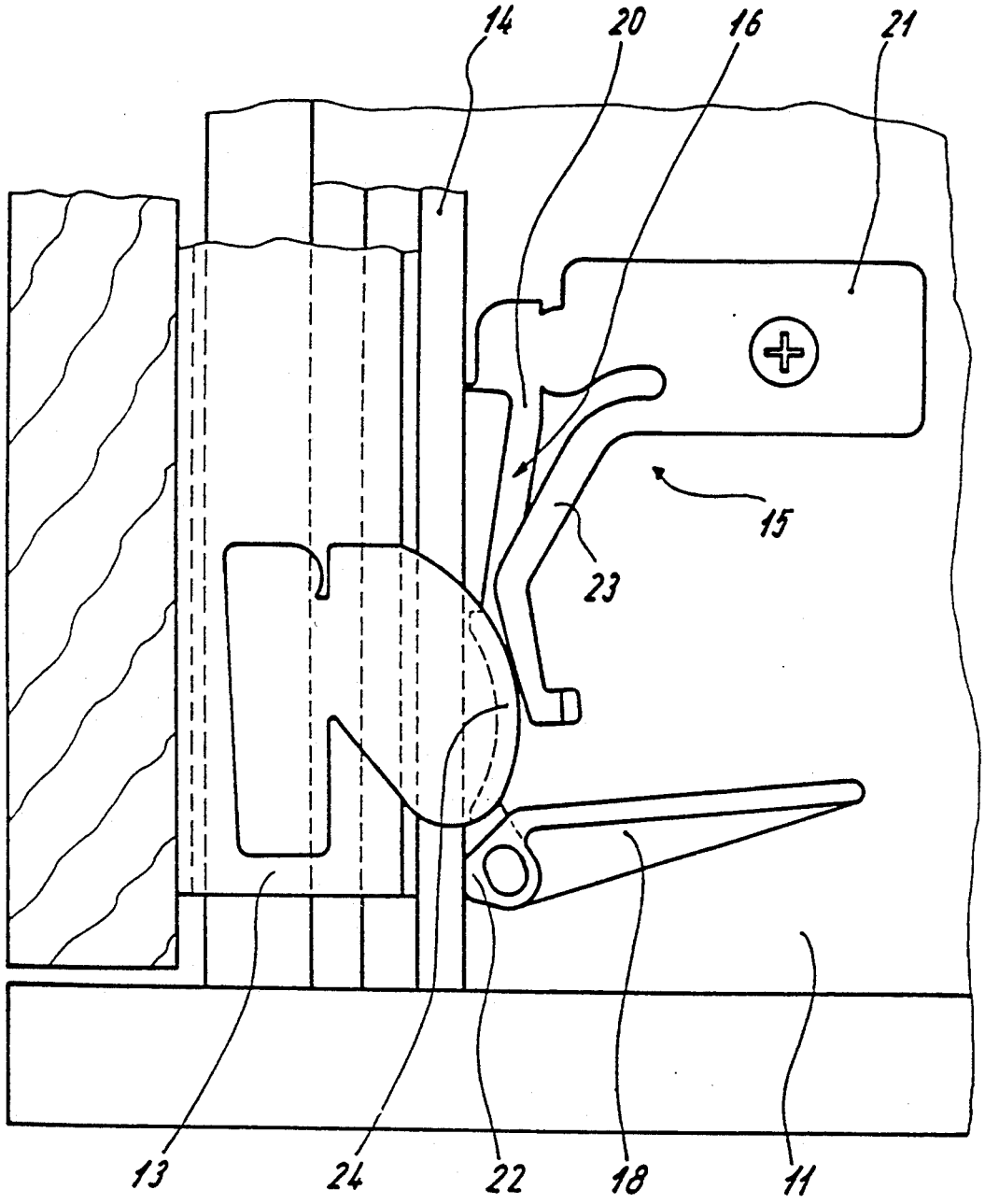
FIG. 2 is a fragmentary view in the direction of the arrow II of FIG. 1.
Figure 5:
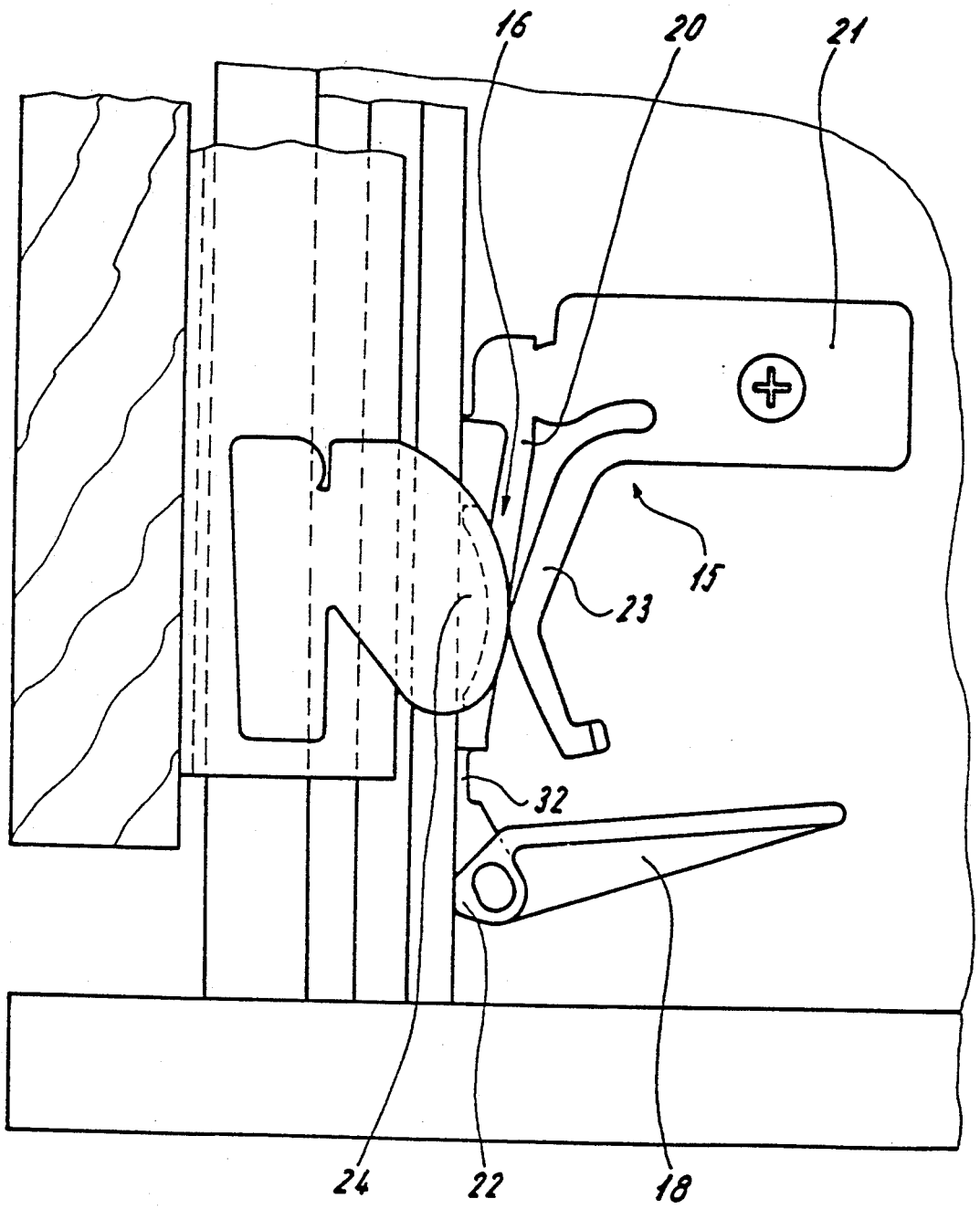
FIG. 5 is a fragmentary view similar to that of FIG. 2 with the leaf, drawer or the like partially withdrawn.
Figure 10:
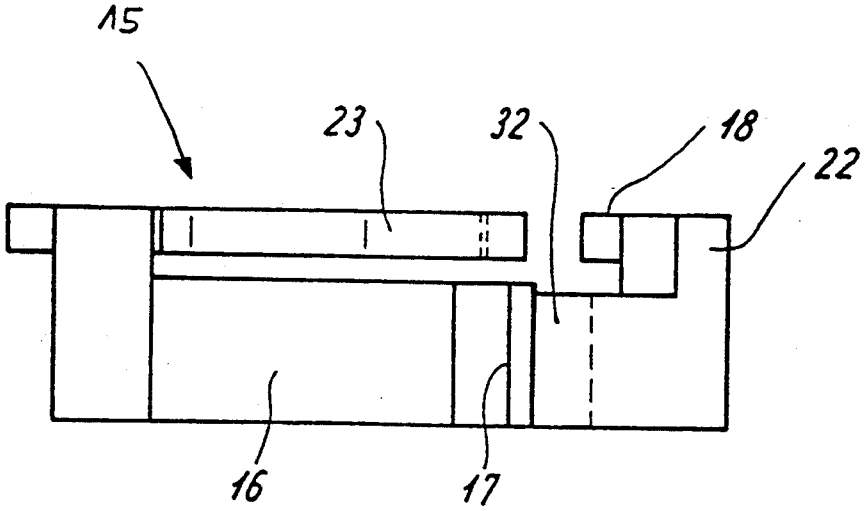
FIG. 10 is a side view of a locking component forming part of the structure of FIGS. 2–5.

It is very clear from FIGS. 2, 5 and 10 that the locking component is provided with a resilient leg 23 in a plane parallel, but displaced relative, to the resilient leg 16. A retaining cam 24 located in the range of movement of the resilient leg 23 is secured to the outer rail 13 in the plane of the resilient leg 23. The resilient leg 23 and the retaining cam 24 together form a retaining device for the drawer 11 in the closed position thereof. The resilient leg 23 travels over the retaining cam 24 during closing of the drawer and secures the closed position of the drawer 11. When the drawer 11 is opened, the retaining cam 24 is again traversed thereby requiring the exertion of a certain force.

The entire locking component 15 including the resilient leg 16, the lever 18 and the resilient leg 23 is preferably made of one piece from plastic. The retaining cam 24 is likewise produced in one piece from plastic.

Figure 6:
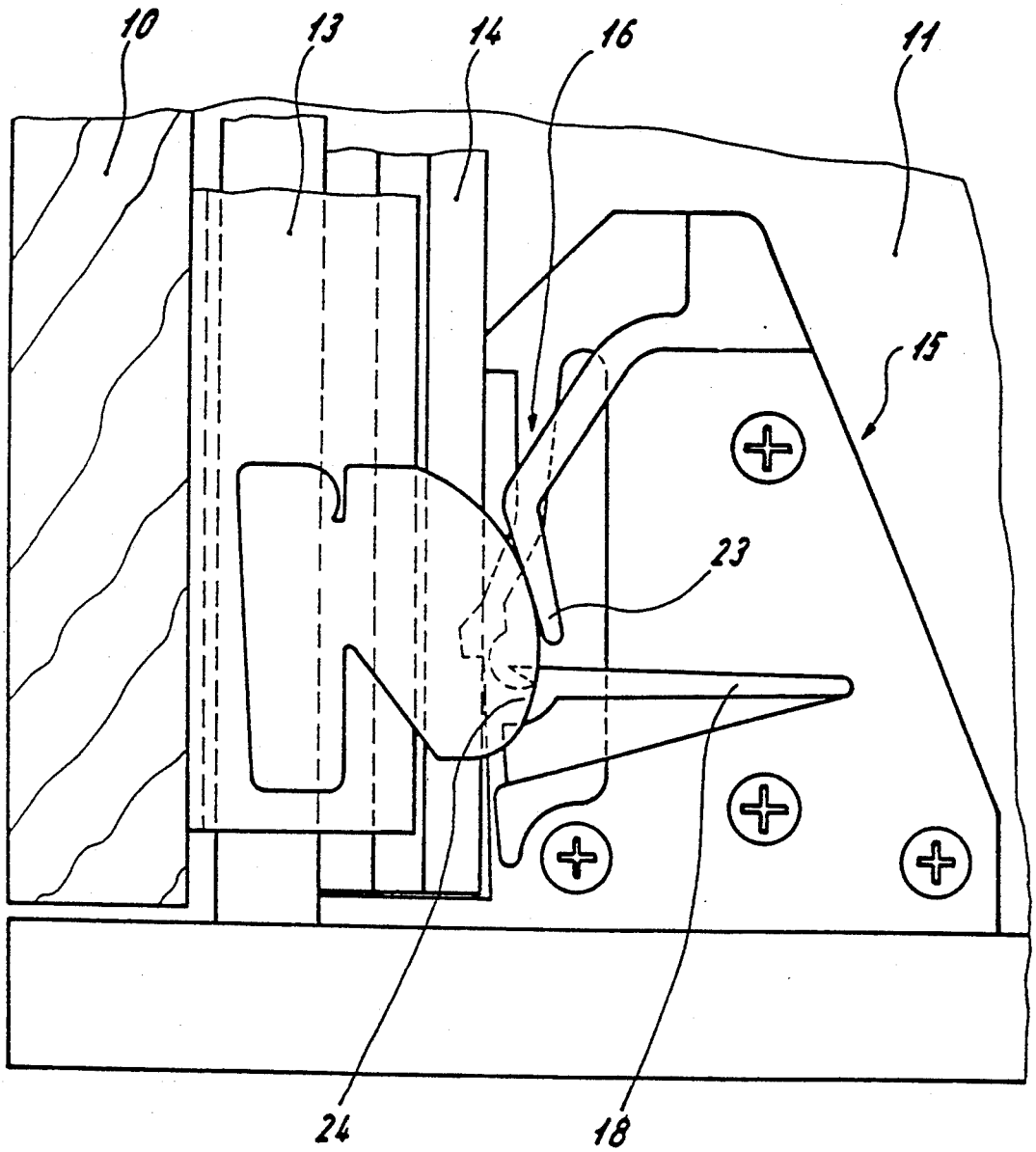
FIG. 6 is a fragmentary view similar to that of FIG. 2, of another embodiment of the invention.
Figure 7:
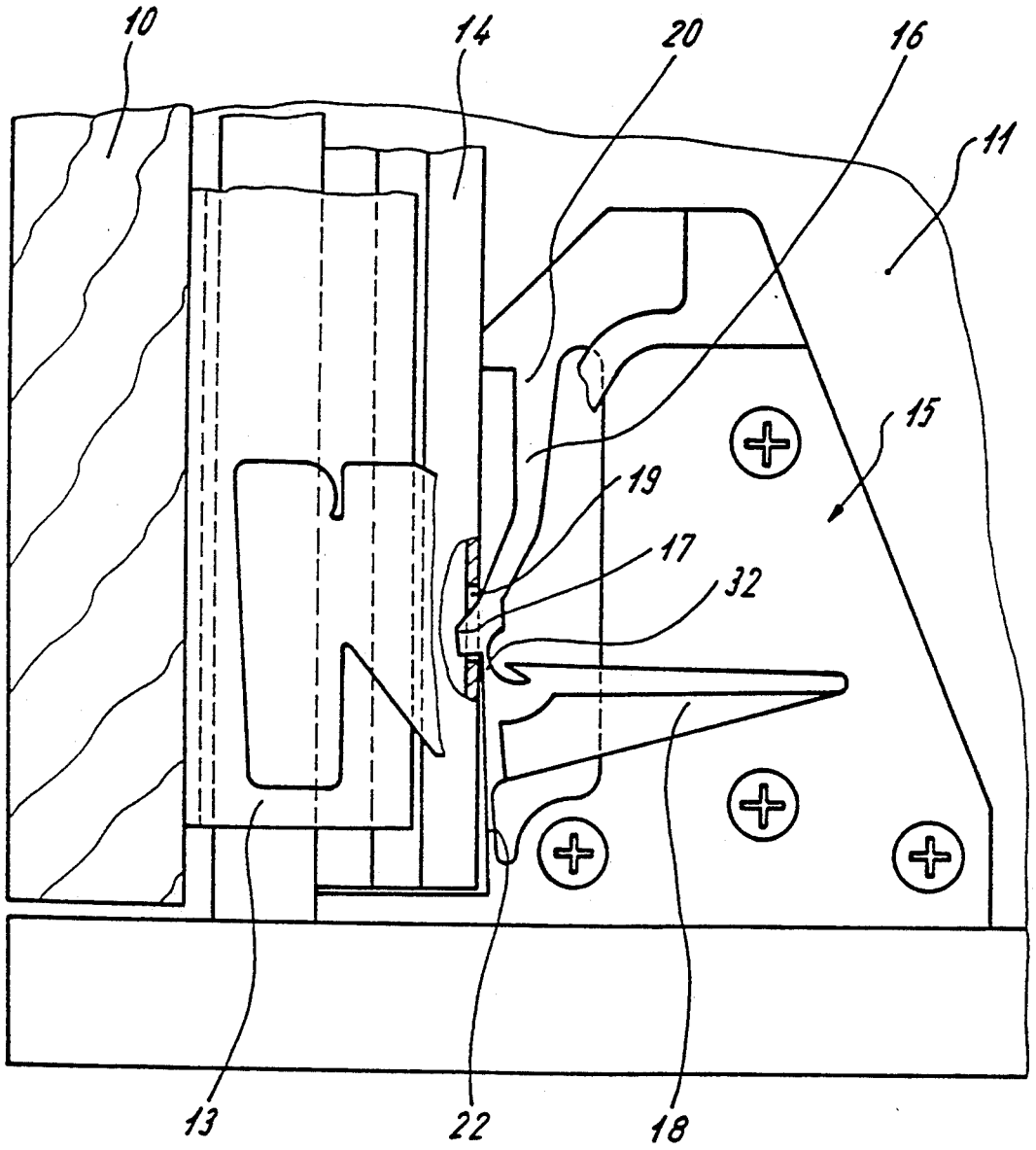
FIG. 7 is a fragmentary view similar to that of FIG. 6 but with a portion of the structural components shown in FIG. 6 omitted.

The embodiment of the invention illustrated in FIGS. 6 and 7 differs from the previously described embodiment only in that the section of the locking component 15 which is secured to the drawer 11 is connected to both ends 20 and 22 of the resilient leg 16 formed with the locking projection 17. The function and operation of the locking component 15 are the same as in the embodiment of FIGS. 2 to 5.

Figure 8:
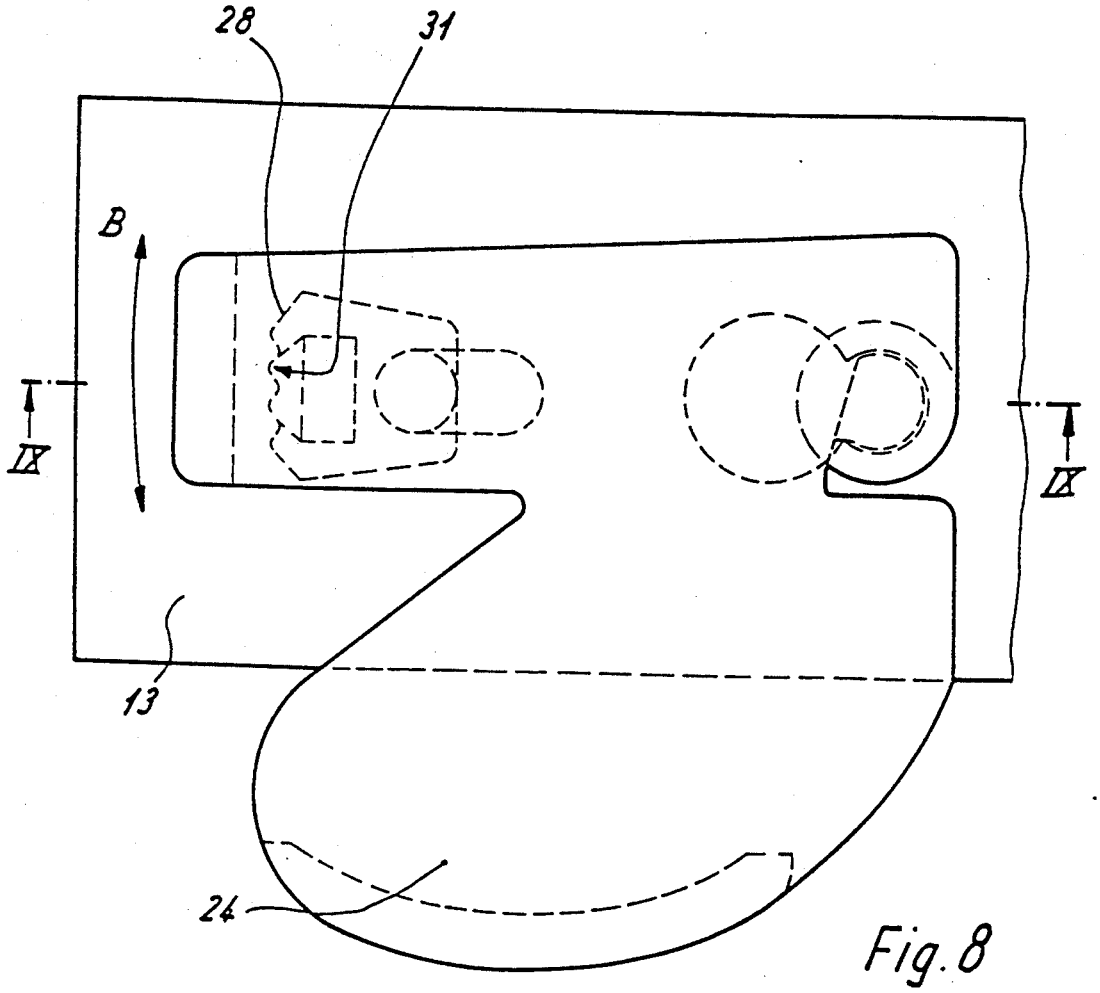
FIG. 8 is an enlarged view of a retaining cam secured to an outer rail.
Figure 9:
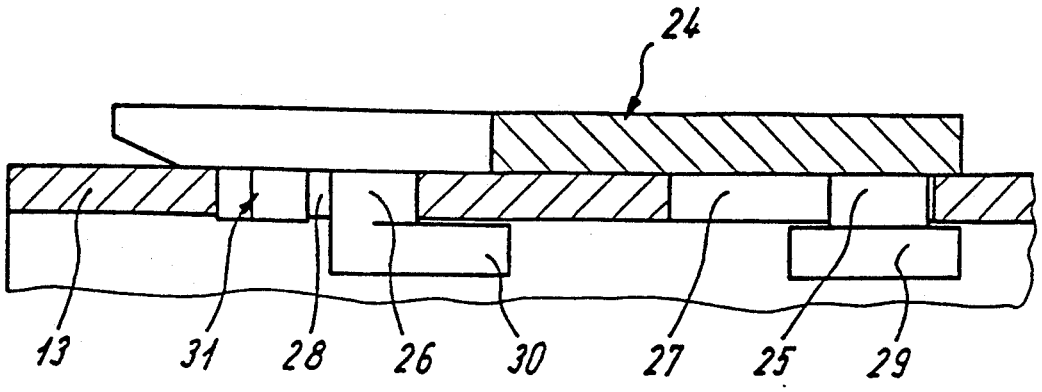
FIG. 9 is a section along the line IX—IX of FIG. 8.

FIGS. 8 and 9 show that the retaining cam 24 is releasably connected to the outer rail 13 via two protuberances 25 and 26 on the retaining cam 24. The protuberances 25 and 26 pass through the respective openings 27 and 28 in the outer rail 13 and are provided with heads 29 and 30 which engage behind the openings 27 and 28. Furthermore, the retaining cam 24 is adjustable transverse to the longitudinal direction of the outer rail 13 which is seen particularly clearly in FIG. 8.

As clearly shown in FIG. 8, the part of the retaining cam 24 passing through the guide rail 13 is provided with a toothed arresting portion 31 which cooperates with a correspondingly toothed section of the opening 28 in the guide rail 13. The entire retaining cam 24 can be pivoted relative to the guide rail 13 in accordance with the double-headed arrow B illustrated in FIG. 8 and can thus be shifted, to a greater or lesser degree, into the range of movement of a resilient leg 23 constituting part of a locking component 15. The retaining forces can accordingly be varied within certain limits.

As is apparent from FIGS. 3 to 5 and 7, each leg 16 has a transition region between the lever 18 and the section of the leg 16 with the locking projection 17, and a cassette hinge 32 is provided in the respective transition region. Furthermore, these FIGURES make it clear that each lever 18 is longer than the distance between the respective cassette hinge 32 and the support point for the lever 18, i.e., the moment arm which arises upon intentional actuation of the lever 18 to effect a release is considerably longer than the moment arm resulting from the structural design. Intentional release thus requires relatively little force.

We claim:

1. A guide for an extendible and retractable component of an article of furniture, comprising at least one elongated guide member having an aperture; and a device for connecting said one guide member to the furniture component, said device including a mounting portion having means for securing said device to the furniture component, an arresting leg having a first end connected to said mounting portion, a second end and an arresting portion receivable in said aperture to establish a connection with said one guide member, and a lever for disengaging said arresting portion from said one guide member, said lever being connected to said leg at a location remote from said first end, said leg having a flexible portion between said arresting portion and said lever to permit flexing thereof upon actuation of said lever with resultant displacement of said arresting portion from said aperture.

2. The guide of claim 1, wherein said one guide member comprises a rail.

3. The guide of claim 1, wherein said arresting portion comprises a projection on said leg.

4. The guide of claim 1, wherein said lever is arranged to extend substantially perpendicular to said one guide member when said one guide member is connected to the furniture component.

5. The guide of claim 1, wherein said lever extends transversely of said leg.

6. The guide of claim 1, wherein said lever is located at said second end of said leg.

7. The guide of claim 1, wherein said device is made in one piece of plastic.

8. The guide of claim 1, wherein said second end of said leg is connected to said mounting portion.

9. The guide of claim 1, wherein said second end of said leg is free and bears against said one guide member when said one guide member is connected to the furniture component by said device.

10. The guide of claim 1, wherein said leg flexible portion is a hinge.

11. The guide of claim 1, wherein said mounting portion comprises means for securing said device to the furniture component such that said lever is located underneath the furniture component.

12. The guide of claim 1 for use with an extendible and retractable furniture component having a front side, wherein said mounting portion comprises means for securing said device to the furniture component such that said lever is located underneath the furniture component and is movable in a direction towards the front side thereof.

13. The guide of claim 1 wherein said lever has a nose which engages said elongated guide member when said lever is actuated to provide a lever camming action to flex said leg flexible portion.

14. A guide for an extendible and retractable component of an article of furniture, comprising at least one elongated guide member having an aperture; and a device for connecting said one guide member to the furniture component, said device including a mounting portion having means for securing said device to the furniture component, an arresting leg having first and second ends and an arresting portion receivable in said aperture so as to establish a connection with said one guide member, a lever for disengaging said arresting portion from said one guide member, and a hinge between said arresting portion and said lever to permit flexing upon actuation of said lever with resultant displacement of said arresting portion, said lever being connected to said leg at a location remote from said first end, and said first end being connected to said mounting portion, said lever projecting from said device at a predetermined location of said device and having a length exceeding the distance between said hinge and said predetermined location.

15. A guide for an extendible and retractable component of an article of furniture, comprising a first elongated guide member having an aperture; a device for connecting said first guide member to the furniture component, said device including a mounting portion having means for securing said device to the furniture component, an arresting leg having first and second ends and an arresting portion receivable in said aperture so as to establish a connection with said first guide member, a lever for disengaging said arresting portion from said first guide member, and a second leg having a section which is substantially parallel to said arresting leg, said lever being connected to said arresting leg at a location remote from said first end, and said first end being connected to said mounting portion; a second elongated guide member which cooperates with said first guide member to guide the furniture component between an extended position and a retracted position; and a retaining cam mounted on said second guide member such that said cam and said section are substantially coplanar at least in the retracted position of the furniture component and cooperate to bias the furniture component into the retracted position.

16. The guide of claim 15, wherein said second leg is resilient.

17. The guide of claim 15, wherein each of said guide members comprises a rail.

18. The guide of claim 15, wherein said cam and said other guide member cooperate to couple said cam to said other guide member so that said cam is adjustable transversely of said other guide member.

19. The guide of claim 15, wherein said cam is made in one piece of plastic.

20. The guide of claim 15, wherein said other guide member is provided with a pair of openings extending between first and second sides of said other guide member, said cam being disposed on said first side and having a pair of protuberances which project through respective ones of said openings to said second side, and each of said protuberances being provided with a head which engages said second side.

21. The guide of claim 15, wherein said other guide member is provided with an opening having a toothed section, said cam having a toothed portion which meshes with said toothed section.

* * * * *